US007201298B2

(12) United States Patent
Miura

(10) Patent No.: US 7,201,298 B2
(45) Date of Patent: Apr. 10, 2007

(54) GARMENT HANGER

(75) Inventor: Shozo Miura, Fukuoka (JP)

(73) Assignee: Maruso Industry Co., Ltd., Fukuoka-ken (JP)

( * ) Notice: Subject to any disclaimer, the term of this patent is extended or adjusted under 35 U.S.C. 154(b) by 386 days.

(21) Appl. No.: 10/839,290

(22) Filed: May 6, 2004

(65) Prior Publication Data

US 2005/0115993 A1 Jun. 2, 2005

(30) Foreign Application Priority Data

Nov. 28, 2003 (JP) ..... P2003-400361

(51) Int. Cl.
*A41D 27/22* (2006.01)

(52) U.S. Cl. ..... 223/89; 223/98

(58) Field of Classification Search ..... 223/85–98
See application file for complete search history.

(56) References Cited

U.S. PATENT DOCUMENTS

| | | | | |
|---|---|---|---|---|
| 2,622,742 | A * | 12/1952 | Oldham | 211/113 |
| 6,779,695 | B2 * | 8/2004 | Matkovich | 223/93 |
| 2005/0011917 | A1 * | 1/2005 | Tubman et al. | 223/85 |

FOREIGN PATENT DOCUMENTS

| | | |
|---|---|---|
| JP | 61-30551 | 9/1986 |
| JP | 11-313749 | 11/1999 |
| JP | 11-318684 | 11/1999 |
| JP | 2000-60715 | 2/2000 |
| JP | 2001-169894 | 6/2001 |
| JP | 2003-169998 | 6/2003 |

* cited by examiner

*Primary Examiner*—Shaun R. Hurley
(74) *Attorney, Agent, or Firm*—Wenderoth, Lind & Ponack, L.L.P.

(57) ABSTRACT

A garment hanger includes a hook portion, a neck portion connected to a base end of the hook portion, a pair of shoulder-supporting portions molded integrally with the neck portion and extend from both sides of the neck portion, a shoulder pad connected to each of the shoulder-supporting portions via a hinge portion, and an engaging leg portion and a locking portion to hold the shoulder pad in a folded state so that the shoulder pad covers each of the shoulder-supporting portions. By providing the shoulder pad to be connected to the shoulder-supporting portion via the hinge portion, the shoulder pad, which has the function of preventing shoulders of a garment from being deformed, is integrated. The shoulder pad can be assembled through a one-touch operation by simply folding the shoulder pad at the hinge portion and engaging the shoulder pad with the shoulder-supporting portion.

9 Claims, 5 Drawing Sheets

GARMENT HANGER

BACKGROUND OF THE INVENTION

1. Field of the Invention

This invention relates to a garment hanger capable of preventing shoulders of a jacket from being deformed.

2. Description of the Related Art

Jackets such as business suit coats, blazers or the like that have been cleaned at laundries are kept hung on hangers to maintain their shapes until the customers collect them. Such hangers used at laundries must be as inexpensive as possible because the price of hangers is only a nominal addition to laundry charges.

Conventionally, wire hangers have been the most prominent and widely used type. However, as wire is small in diameter and thin, the shoulders of a jacket kept hung on a wire hanger are creased and lose their original shape. Garments collected from laundries tend not to be worn for some time. In particular, garments returned from laundries at the end of a season are often kept hung on hangers with dust covers in wardrobes until the next appropriate season comes after several months. Thus, not only shoulders, but also the front and back portions sag and crease, and these creases are unlikely to smooth out when the garments are worn.

In order to solve the above problems, Unexamined Japanese Patent Publications No. 2000-060715, 2001-169894, Hei 11-313749 and Hei 11-318684, for example, disclose hangers provided with pads mounted on their shoulder parts to round corners of the hangers.

Unexamined Japanese Patent Publication No. 2003-169998 discloses a hanger in which shoulder members are integrally formed and mounted to a hanger body.

Japanese Utility Model Publication No. Sho 61-30551 discloses a hanger cover to be attached to a wire hanger in which shoulder-portion-forming members are integrally mounted to both sides of a neck-portion-forming member having a through hole for inserting a hanger hook, and a slit to be closed after assembly is formed from a bottom to a top of the neck-portion-forming member at a center thereof.

However, in the hangers described in Unexamined Japanese Patent Publications No. 2000-060715, 2001-169894, Hei 11-313749 and Hei 11-318684, at least three members, that is, a hanger body and two pads for both shoulders are required, which increases production costs and also makes assembly processes complex.

In this regard, the hanger described in Unexamined Japanese Patent Publication No. 2003-169998 requires only two members because the pad for both shoulders is formed as a single part. Still, processes for manufacturing a plurality of members and assembling them are needed, posing limitations on cost saving.

In addition, when transporting the hangers disclosed in the above five publications from manufacturers to laundries or cleaning factories, separate containers for respective members are necessary, leading to higher transport costs.

According to the hanger cover disclosed in the above sixth publication, i.e., Japanese Utility Model Publication No. Sho 61-30551, a large number of hangers can be closely stacked. However, as the hanger cover is mounted to a wire hanger for use, the manufacturing cost is high.

Apart from the above-described hangers, there have been three-dimensional hangers made of plastic with both shoulder parts formed in three-dimensional configurations. These hangers require high production costs. In addition, as the three-dimensional hangers cannot be stacked, it is difficult to put a large number of hangers in a box for transporting, requiring higher transportation expenses.

An object of the present invention is to provide a low-cost garment hanger with a function of preventing shoulders of a garment from being deformed, which can be assembled through a one-touch operation, does not occupy much space in transit, and reduces the number of members.

SUMMARY OF THE INVENTION

In order to solve the above problems, a first aspect of the present invention is a garment hanger comprising a hook portion, a neck portion connected to a base end of the hook portion, and a pair of shoulder-supporting portions which are molded integrally with the neck portion and which extend from both sides of the neck portion. The garment hanger further comprises a shoulder pad which is connected to each of the shoulder-supporting portions via a hinge portion and which is foldable at the hinge portion, and an engaging means to hold the shoulder pad in a folded state so that the shoulder pad covers each of the shoulder-supporting portions.

In the first aspect of the invention, by providing the shoulder pad to be connected to the shoulder-supporting portion via the hinge portion and to be foldable at the hinge portion, the shoulder pad, which has the function of preventing shoulders of a garment from being deformed, is integrated. Moreover, the shoulder pad can be assembled through a one-touch operation by simply folding the shoulder pad at the hinge portion and engaging the shoulder pad with the shoulder-supporting portion.

A second aspect of the present invention is the garment hanger wherein the engaging means comprises a claw portion projecting from an upper side of each of the shoulder-supporting portions, and a top portion of a trapezoid rib to engage with the claw portion.

In the second aspect of the present invention, by forming the engaging means with the claw portion and the top portion of the trapezoid rib, the hanger can be assembled through a one-touch operation.

A third aspect of the present invention is the garment hanger further comprising a beam which is connected to lower ends of the shoulder-supporting portions.

In the third aspect of the present invention, by integrally molding the beam, trousers or skirts can be hung over the beam.

A fourth aspect of the present invention is the garment hanger wherein the hook portion is molded integrally with the neck portion without requiring any other members.

A fifth aspect of the present invention is the garment hanger wherein the hook portion is formed separately from the neck portion and attached to the neck portion afterward. In this case, the hook portion made of a wire, for example, has a reinforcing effect.

According to the present invention, by providing the shoulder pad to be connected to each of the shoulder-supporting portions via the hinge portion and to be foldable at the hinge portion, a low-cost garment hanger with a function of preventing shoulders of a garment from being deformed, which can be assembled through a one-touch operation, and does not occupy much space in transit.

DETAILED DESCRIPTION OF THE PREFERRED EMBODIMENT

Figure 1:
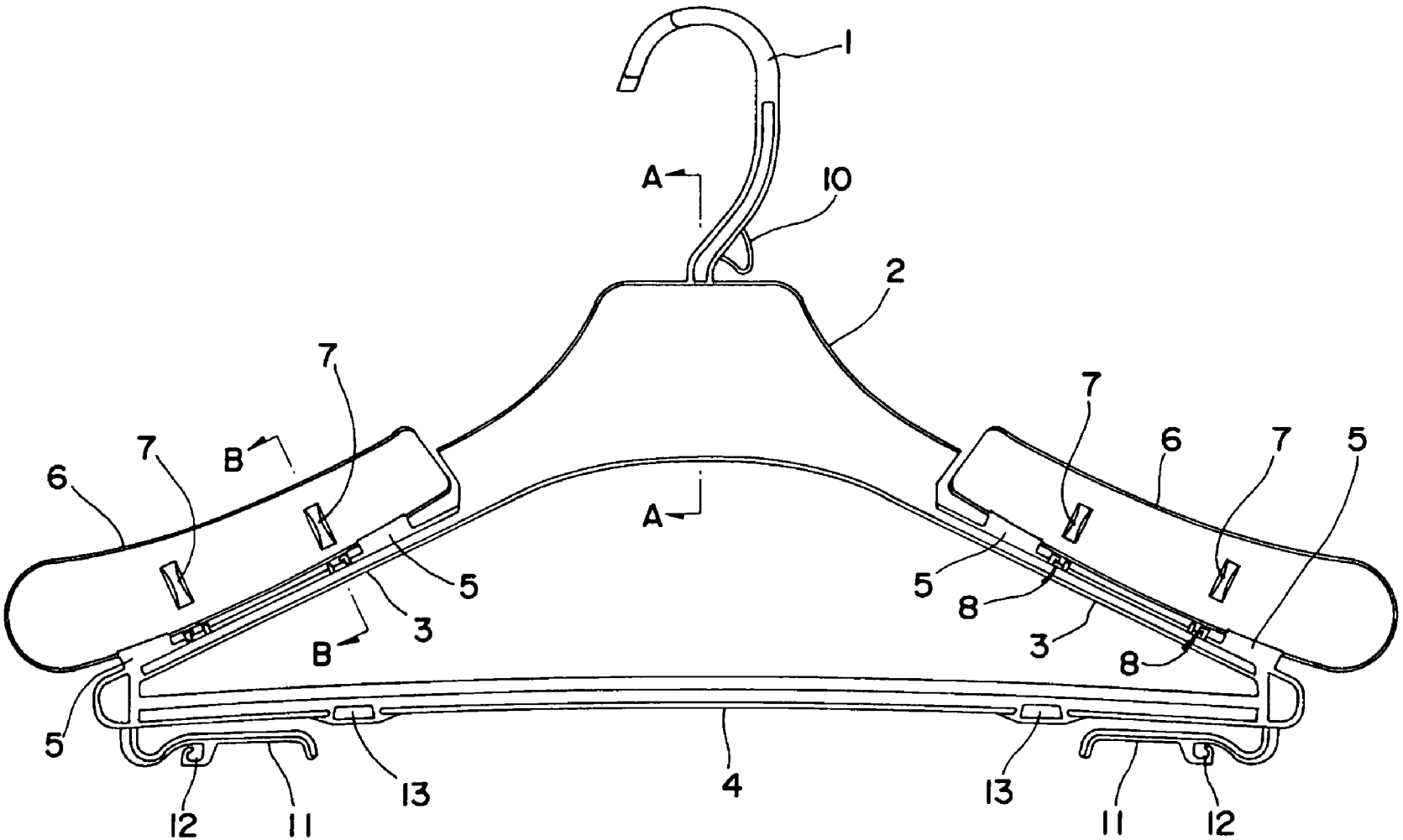
FIG. 1 is a front view of a garment hanger of an embodiment of the present invention where both shoulder pads are opened.
Figure 2:
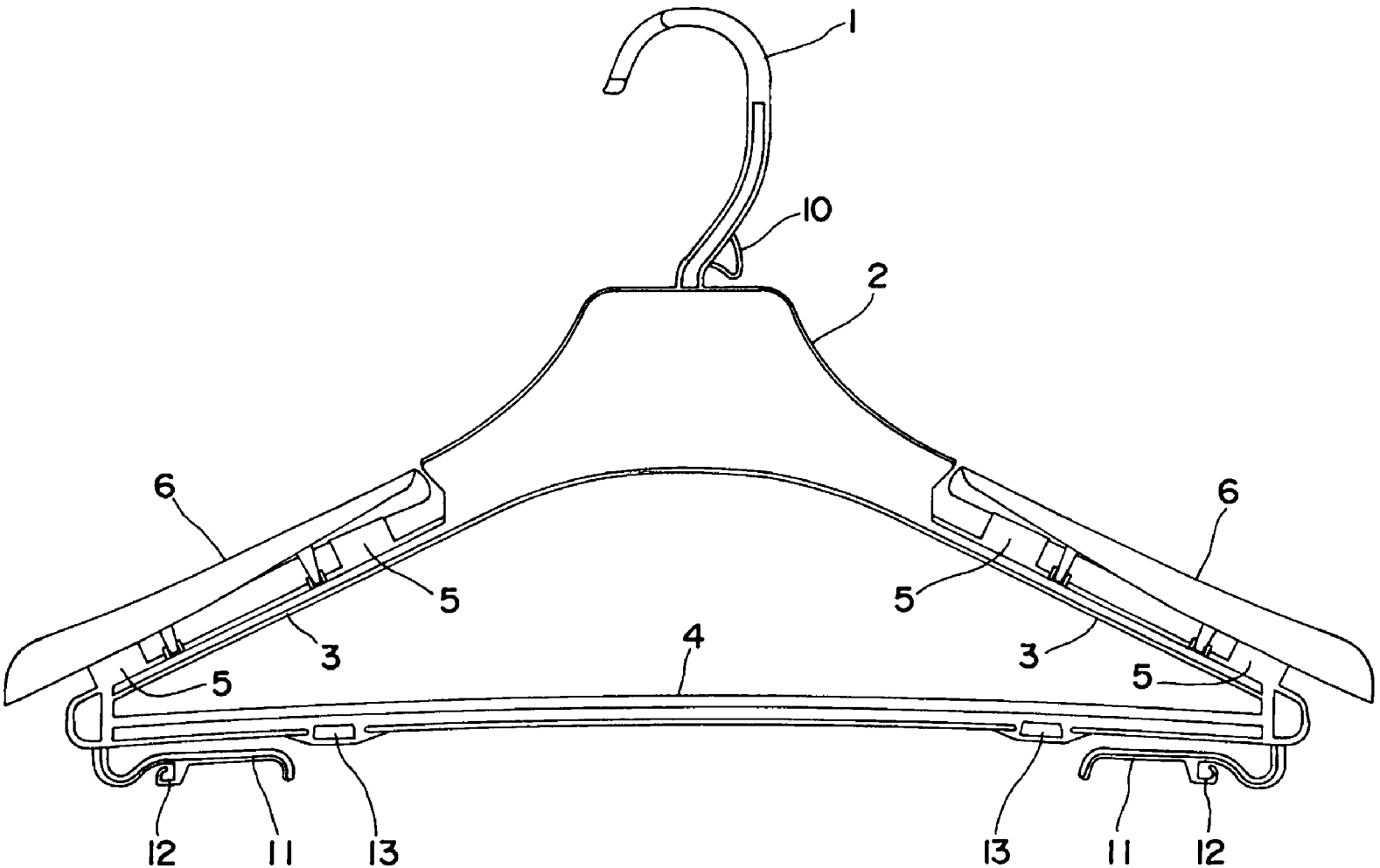
FIG. 2 is a front view of the garment hanger of the embodiment where both shoulder pads are set on shoulder-supporting portions.

With reference to FIGS. 1 to 7, an embodiment of the present invention will be described below.

In FIGS. 1 to 7, a garment hanger of the present embodiment comprises a hook portion 1, a neck portion 2 connected to a base end of the hook portion 1, a pair of shoulder-supporting portions 3 extending from both sides of the neck portion 2, a beam 4, and shoulder pads 6 connected to the shoulder-supporting portions 3 via hinge arms 5.

As a material for the garment hanger, thermoplastic resin capable of injection molding such as polypropylene or the like can be employed.

Figure 6:
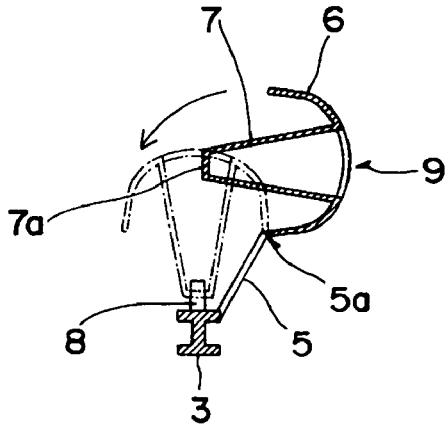
FIG. 6 is a sectional view taken along the line B—B in FIG. 1.
Figure 7:
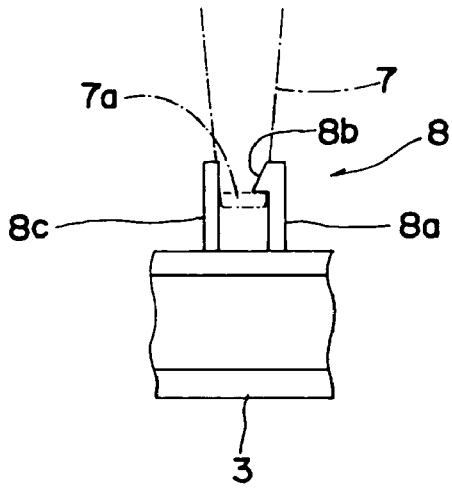
FIG. 7 is an enlarged view showing a locking portion in the embodiment of the present invention.

During the injection molding, as shown in FIG. 6, the hinge arm 5 also functions as a gate through which resin flows in from the shoulder-supporting portion 3 to the shoulder pad 6, and each connecting portion between the hinge arm 5 and the shoulder pad 6 has a thinned portion to form a hinge portion 5*a* that is freely foldable.

On each lower side of the shoulder pads 6, V-shaped engaging leg portions 7 are provided. Each top end of the engaging leg portions 7 has a flat area to form an engaging portion 7*a*, thereby forming a trapezoid rib as a whole. At a position corresponding to the engaging portion 7*a* of the shoulder-supporting portion 3, as shown in the enlarged view of FIG. 7, a locking portion 8 consisting of a locking member 8*a* with a locking claw 8*b* on its end and a securing member 8*c* is provided. The locking claw 8*b* has a function of catching the engaging portion 7*a* of the engaging leg portion 7. In order to guide the engaging portion 7*a* to an area between the locking member 8*a* and the securing member 8*c* when fitting the engaging portion 7*a*, an end portion of the locking member 8*a* and an upper portion inside the securing member 8*c* are tapered. On the shoulder pad 6, as shown in FIG. 6, an opening 9 is formed in an area where the engaging leg portion 7 is provided. Thus, when stacking the hangers, the engaging leg portion 7 of one garment hanger is inserted into the opening 9 of another overlaying hanger, which enables a plurality of hangers to be closely stacked as further described below.

In the drawings, 10 denotes a ring holder through which, when the garment hanger of the present invention is hung on or taken off from a rail running in a high position using a stick-like picking device provided with a hook on its end, the hook is hitched. 11 denotes a slip-preventing member used for nipping trousers or a skirt hung over the beam 4 to be folded in two. 12 denotes a hook for hanging a loop provided inside a waist band of a skirt, and 13 denotes a hole for securing a clip used for fixing a skirt.

Next, functions of the above-described embodiment are explained below.

Figure 3:
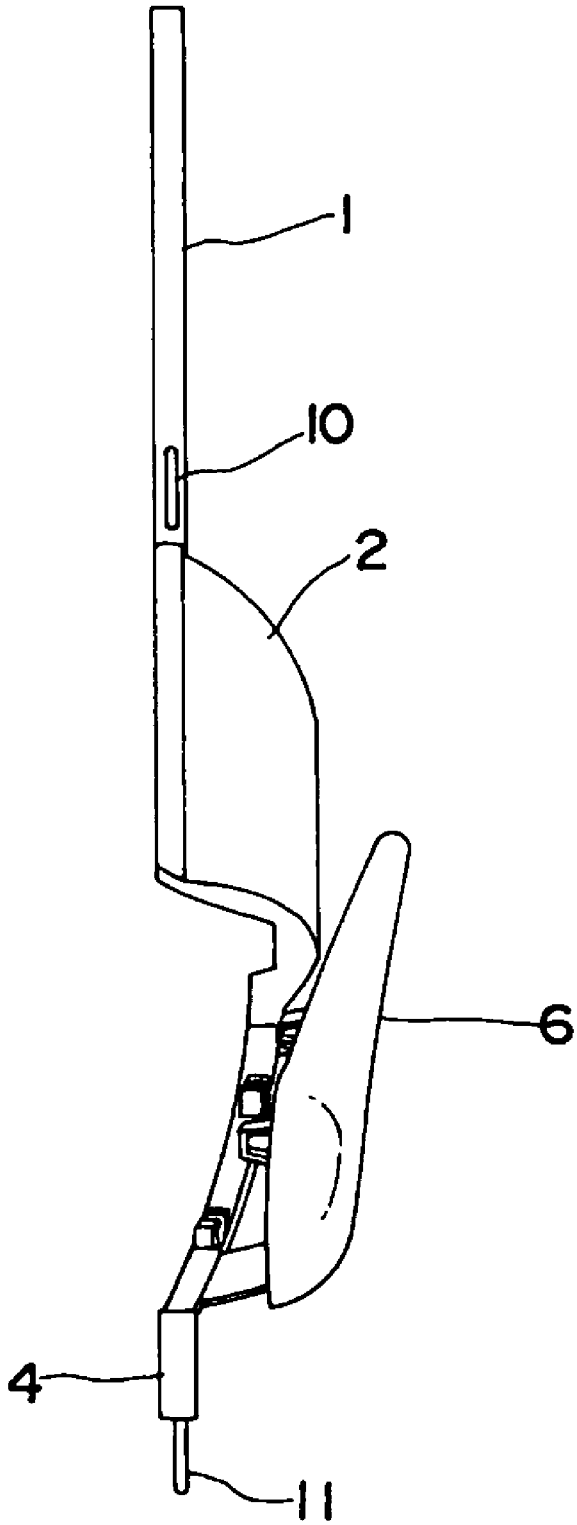
FIG. 3 is a side view of the garment hanger of the embodiment where the shoulder pads are opened.
Figure 4:
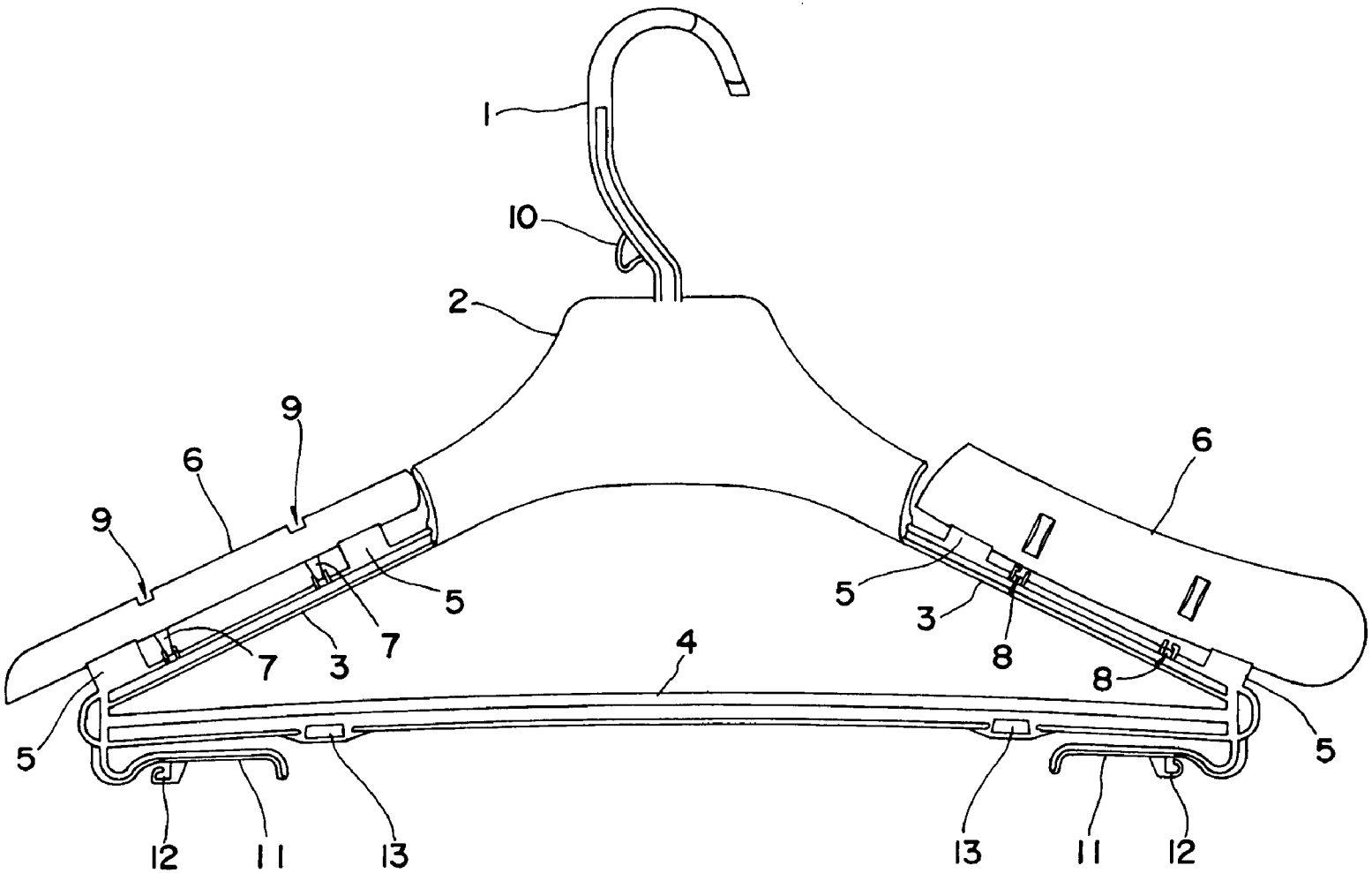
FIG. 4 is a rear view of the garment hanger of the embodiment where one of the shoulder pads is opened.

After the garment hanger is formed by injection molding, as shown in FIGS. 1 and 3, the shoulder pads 6 are in an open state, or are not engaged with the shoulder-supporting portions 3. A multiplicity of the garment hangers can be closely stacked in this state. Specifically, upper faces of the neck portion 2 and the shoulder pad 6 of one hanger can fit into lower faces of the neck portion 2 and the shoulder pad 6 of another hanger, respectively. Furthermore, the opening 9 provided in the area where the engaging leg portion 7 is projected enables the hangers to be stacked closely.

When using the garment hanger, as shown in FIG. 6, by folding the shoulder pad 6 at the hinge portion 5*a*, the engaging portion 7*a* at the end of the engaging leg portion 7 abuts against the locking portion 8. With further pressure onto the shoulder pad 6, the locking member 8*a* and the securing member 8*c* constituting the locking portion 8 are bent outwardly to receive the engaging portion 7*a* passing over the locking claw 8*b*, thereby fixing the shoulder pad 6 by restraining its resilient force to open. In this manner, by simply folding the shoulder pad 6 at the hinge portion 5*a* and pushing it on the shoulder-supporting portion 3, the garment hanger can be assembled through a one-touch operation. Thus, as an upper portion of the shoulder-supporting portion 3 is covered with the shoulder pad 6, a garment can be hung on the hanger with its shoulders kept in a proper round shape.

When the garment hanger is not in use, the shoulder pad 5 is strongly pulled and unfolded at the hinge portion 5*a* so that the locking claw 8*b* is bent to release the engaging portion 7*a* from the locking portion 8. Thus, the garment hangers can be stacked again.

Figure 5:
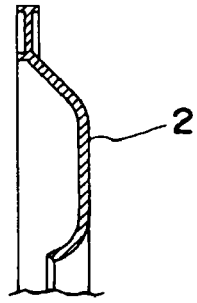
FIG. 5 is a sectional view taken along the line A—A in FIG. 1.

In the above embodiment, as shown in FIG. 5, the neck portion 2 has a curved configuration to fit around a neck portion of a garment. However, the neck portion 2 may have a simple flat configuration.

The hook member 1 shown in the above embodiment is molded integrally with the neck portion 2 and other members. In the case that further strength is required, however, a metallic member separately formed from a curved wire may also be employed.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A garment hanger comprising:

a hook portion;

a neck portion connected to a base end of the hook portion;

a pair of shoulder-supporting portions which are molded integrally with said neck portion and extend from respective sides of the neck portion;

a pair of shoulder pads which are each connected to a respective one of said shoulder-supporting portions via a respective hinge portion so as to be foldable at the respective hinge portion; and an engaging member to hold said shoulder pads in a folded state so that each of said shoulder pads covers said respective one of said shoulder-supporting portions.

2. The garment hanger according to claim 1, wherein said engaging member comprises:

a claw portion projecting from an upper side of each of the shoulder-supporting portions; and a top portion of a trapezoid rib to engage with the claw portion.

3. The garment hanger according to claim 1, further comprising:

a beam which is connected to lower ends of said shoulder-supporting portions.

4. The garment hanger according to claim 2, further comprising:

a beam which is connected to lower ends of said shoulder-supporting portions.

5. The garment hanger according to claim 1, wherein said hook portion is molded integrally with the neck portion.

6. The garment hanger according to claim 1, wherein said hook portion is formed separately from the neck portion and attached to the neck portion.

7. The garment hanger according to claim 1, wherein each of said shoulder pads is molded integrally with said respective one of said shoulder-supporting portions.

8. The garment hanger according to claim 7, wherein each of said shoulder pads is foldable about an axis parallel to a longitudinal axis of a respective one of said shoulder-supporting portions.

9. The garment hanger according to claim 1, wherein each of said shoulder pads is foldable about an axis parallel to a longitudinal axis of a respective one of said shoulder-supporting portions.

* * * * *